US006234413B1

(12) United States Patent
Greaney

(10) Patent No.: US 6,234,413 B1
(45) Date of Patent: May 22, 2001

(54) INJECTOR AND INJECTOR ASSEMBLY

(75) Inventor: Adrian Mark Greaney, Sittingbourne (GB)

(73) Assignee: Lucas Industries Limited, London (GB)

( * ) Notice: Subject to any disclaimer, the term of this patent is extended or adjusted under 35 U.S.C. 154(b) by 0 days.

(21) Appl. No.: 09/437,283

(22) Filed: Nov. 10, 1999

(30) Foreign Application Priority Data

Nov. 12, 1998 (GB) ..... 9824735

(51) Int. Cl.[7] ..... F02M 59/00
(52) U.S. Cl. ..... 239/533.2; 239/88; 123/470
(58) Field of Search ..... 239/533.2–533.12, 239/88–92; 123/470, 509, 469, 468, 456, 457

(56) References Cited

U.S. PATENT DOCUMENTS 3,845,748 * 11/1974 Eisenberg ..... 123/468
4,365,756 * 12/1982 Fisher ..... 239/533.2
5,365,907 * 11/1994 Dietrich et al. ..... 123/468
5,617,828 * 4/1997 Kuegel et al. ..... 123/470
5,775,303 * 7/1998 Sweetland et al. ..... 123/470

FOREIGN PATENT DOCUMENTS

4140668 * 7/1992 (DE) ..... 123/469
4319269 * 12/1994 (DE) ..... 123/469
569727 * 11/1993 (EP) ..... 123/470
210359 * 12/1983 (JP) ..... 123/469

* cited by examiner

*Primary Examiner*—David A. Scherbel
*Assistant Examiner*—Dinh Q. Nguyen
(74) *Attorney, Agent, or Firm*—Ohlandt, Greeley, Ruggiero & Perle, L.L.P.

(57) ABSTRACT

An injector assembly comprising an injector (3) and a wall (1) having an inner surface (2) defining a cavity receiving the injector (3). A peripheral surface portion of the injector (3) and a corresponding portion of the cavity inner surface (2) are configured to inter-engage such that force applied to the injector (3) in a predetermined direction causes mutually oppositely directed reaction forces perpendicular to the applied force which tend to laterally compress the injector (3), for relieving lateral stress within the injector (3). Additionally, an injector (3) for fitting in a cavity of an injector assembly, the injector (3) including an axially extending portion (10) comprising at least two peripheral irregularities in an otherwise substantially regular lateral cross-section.

15 Claims, 1 Drawing Sheet

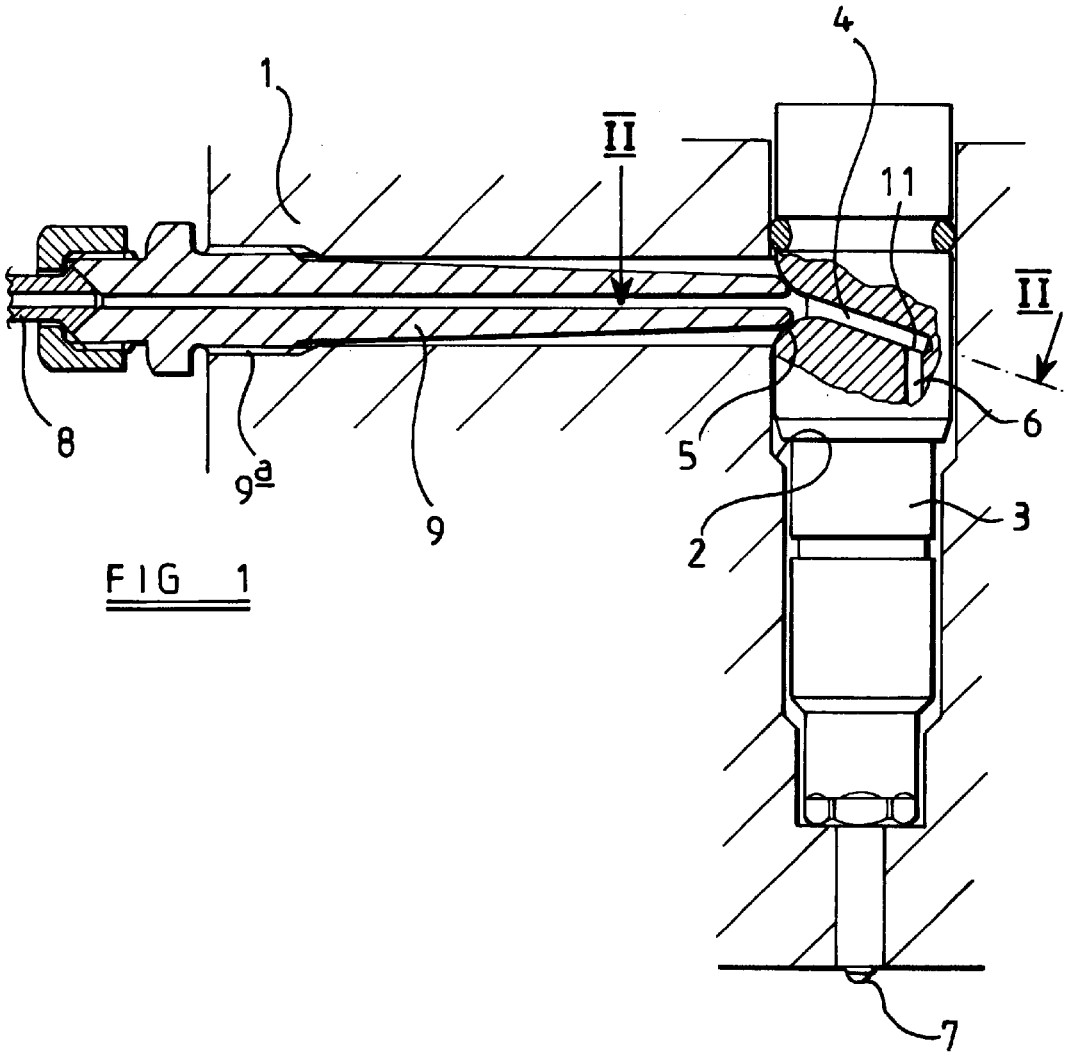
FIG 1
FIG 2
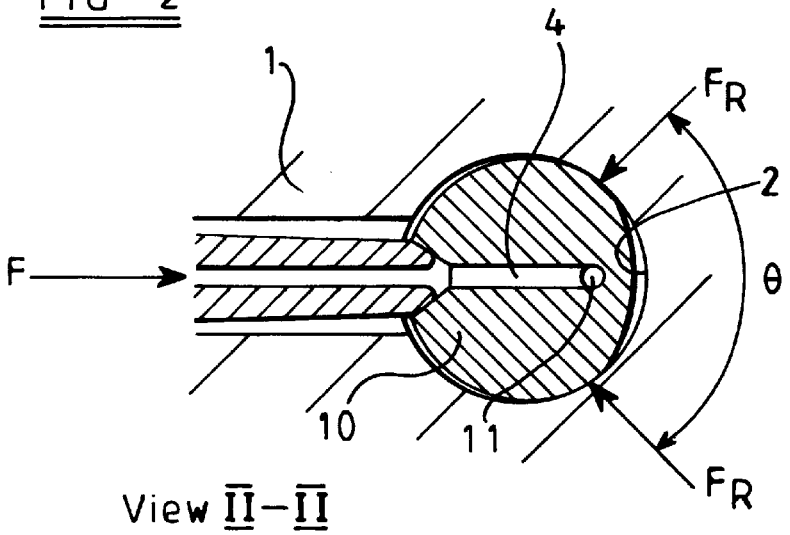
View II–II

INJECTOR AND INJECTOR ASSEMBLY

This invention relates to an injector assembly comprising an injector and a wall having an inner surface defining a cavity receiving the injector. The invention also relates to an injector for fitting in a cavity. The invention is applicable particularly, but not exclusively, to fuel injectors and injector assemblies for internal combustion engines.

In a known type of fuel injector assembly, an injector having an axially extending portion of substantially circular cross-section is closely fitted in a cavity within a cylinder head, the cavity having an inner surface of correspondingly circular cross-section. A connector feeds fuel from a high pressure line into a fuel passageway in the injector. The passageway's inlet opens to the lateral periphery of the axially extending portion of the injector. When the connector is tightly fitted so as to seal against the inlet, lateral force is exerted on the injector. The lateral force causes an equal and opposite reaction force where the substantially concentric surfaces of the injector and cavity meet, in a region diametrically opposite the injector inlet.

Whilst such assemblies have hitherto provided acceptable performance at commonly used levels of fuel pressure, a problem has arisen with such assemblies due to stress concentrations within the injector at a region of intersection of a generally laterally extending drilling and a generally axially extending drilling which together form the fuel passageway. The problem is exacerbated when increased fuel injection pressures are used. Such stress concentrations tend to produce tensile forces acting substantially perpendicularly to the applied force, outwardly of the injector, which may limit the pressure which the injector is able to withstand.

The invention seeks to overcome or mitigate the above-mentioned problem.

SUMMARY OF THE INVENTION

Accordingly, the invention provides an injector assembly comprising an injector and a wall having an inner surface defining a cavity receiving the injector, a peripheral surface portion of the injector and a corresponding portion of the cavity inner surface being configured to inter-engage such that force applied to the injector in a predetermined direction causes mutually oppositely directed reaction forces perpendicular to the applied force which tend to laterally compress the injector, for relieving lateral stress within the injector. This can conveniently be achieved by providing a space between the wall's inner surface and a region of the peripheral surface portion of the injector lying opposite a point of application of the applied force.

The injector and cavity are preferably configured such that reaction forces having two mutually equal and opposite components are caused perpendicular to the applied force.

Where the injector includes a passageway for carrying high pressure fluid leading from the lateral periphery of the injector to an axial end of the injector, the applied force being applied laterally by a connector supplying fluid to the passageway, and the passageway comprises a primarily laterally extending portion and a primarily axially extending portion, the injector and cavity surfaces may conveniently be arranged to direct the mutually opposite reaction forces through a region of the injector where the passageway portions intersect.

Advantageously, an axially extending portion of the injector which includes the above-mentioned peripheral surface portion thereof is part circular in lateral cross-section.

Preferably, this axially extending portion is configured such that the part circular portion of its periphery would provide a close matching fit with the substantially circular corresponding portion of the cavity inner surface, but for a relieved segment of the axially extending portion having an eccentrically disposed peripheral curve with a larger radius of curvature, thereby providing two regions of inter-engagement of the injector and the cavity inner surface for respectively providing the reaction forces.

Alternatively, the injector may comprise an axially extending portion which is substantially circular in lateral cross-section, two irregularities extending radially inwardly from the cavity inner surface, which is otherwise correspondingly circular in cross-section, thereby providing two regions of inter-engagement between the injector and the cavity inner surface for respectively providing the reaction forces.

The connector conveniently applies lateral force in a direction along the primarily laterally extending portion of the passageway midway between the regions of engagement, thereby bisecting the injector.

The wall may comprise a body portion having a bore receiving a sleeve, the inner surface of which defines said cavity.

The invention also includes an injector for fitting in a cavity, the injector having an axially extending portion comprising at least two peripheral irregularities in an otherwise substantially regular lateral cross-section. The axially extending portion may be part circular in lateral cross-section, one segment of this portion having an eccentrically disposed peripheral curve with a large radius of curvature, thereby providing two peripheral irregularities for engaging a cavity inner surface having a substantially circular cross-section.

In order that the invention may be well understood, an example thereof, which is given by way of example only, will now be described with reference to the accompanying drawings, in which:

BRIEF DESCRIPTION OF THE DRAWINGS

FIG. 1 shows a part section through a cylinder head including an injector assembly; and FIG. 2 is a lateral cross-section through the injector assembly shown in FIG. 1.

DESCRIPTION OF THE PREFERRED EMBODIMENT

Referring to the figures, the cylinder head of an internal combustion engine includes a wall 1 having an inner surface 2 defining a cavity receiving an injector 3 for injecting fuel into a cylinder (not shown) of the engine. The injector 3 has a drilling 4 extending primarily laterally from its inlet 5 which opens to the lateral periphery of the injector 3, to an intersection 11 with another drilling 6. The drilling 6 extends primarily axially within the injector 3 from the intersection 11 to connect the first mentioned drilling 4 with an outlet 7. The two drillings 4, 6, together form a passageway for carrying high pressure fuel.

In use, fuel from a high pressure pump is fed through a pipe 8 through a connector 9 into the inlet 5 and is injected into the cylinder through the fuel passageway 4, 6. To provide an effective seal between the inlet 5 of the fuel passageway 4, 6 and the outlet end of the connector 9, the connector 9 is securely fastened to the wall 1 by a screw fastening 9*a* to provide the necessary sealing force. Whilst the exemplary arrangement shows a connector 9 having its axis substantially perpendicular to the axis of the injector 3, it is to be understood that the invention is equally applicable to arrangements where the connector axis is oblique to the injector axis, thereby providing a sealing force having a substantial component in the direction of the axis of the injector in addition to a lateral component.

An axially extending portion 10 of the injector 3, which portion includes the inlet 5, is closely fitted within a corresponding axially extending portion of the cavity having a substantially circular lateral cross-section. As best shown in FIG. 2, disregarding the irregularity formed by the inlet 5, the portion 10 is not circular in lateral cross-section. Rather, a portion 10 of regular circular cross-section has been relieved over a region diametrically opposite the inlet 5, this relieved segment having an eccentrically disposed periphery with a larger radius of curvature. Thus, with the injector 3 fitted in the cavity and lateral force F applied by the connector 9, the axially extending portion 10 of the injector 3 engages the inner surface 2 of the cavity at two points equidistant the line of action of the applied force, which acts along the fuel passageway 4, 6, causing two resultant reaction forces $F_R$ one to either side of the line of action of the applied force F. Each reaction force $F_R$ has a component acting perpendicularly to the direction of the applied force F and passing through the intersection 11 of the drillings 4, 6. A compressive force is thus provided which tends to counteract stress concentrations at the intersection 11 generated by high pressure fuel in the passageway 4, 6, which tend to act in a direction perpendicular to the applied force F. Clearly , this arrangement also avoids the increase in such stress concentration which results from a single reaction force, equal and opposite to the applied force F, acting through the intersection 11.

The applied clamping force F, the location of the engagement points between the injector and cavity surfaces, and the angle θ between the reaction forces $F_R$ in the exemplary embodiment are selected to provide a small compressive stress at the intersection 11 when no high pressure fuel is flowing in the passageway 4, 6. In operation, with fluctuating fuel pressure in the passageway 4, 6, peak and mean stresses experienced at the intersection 11 can be significantly reduced.

Clearly, many other ways of causing reaction forces having compressive components perpendicular to the applied force will be apparent to the skilled man. For example, irregularities may be provided on the inner surface of the cavity offset to either side of the line of the applied force, whereby suitable compressive forces can be obtained using an injector having a substantially circular cross-section. Such irregularities may be formed on the inner surface of a sleeve which is then inserted into a bore in the wall.

Although in the description hereinbefore the applied force results from the action of the inlet connector, it will be appreciated that the invention is also applicable where other applied forces result in the formation of stress concentrations in the injector.

What is claimed is:

1. An injector assembly comprising an injector and a wall having an inner surface defining a cavity receiving said injector, said injector having a peripheral surface portion and said cavity having a portion corresponding to said peripheral surface portion, said peripheral surface portion and said corresponding portion of said cavity inner surface being configured to inter-engage such that the force applied to said injector in a predetermined direction causes mutually oppositely directed reaction forces perpendicular to said applied force which tend to laterally compress said injector, for relieving lateral stress within said injector, wherein said injector and said cavity are configured such that reaction forces having two mutually equal and opposite components are caused perpendicular to said applied force.

2. The injector assembly as claimed in claim 1, said injector having an axial end, wherein said injector includes a passageway for carrying high pressure fluid leading from the lateral periphery of said injector to said axial end, said applied force being applied laterally by a connector supplying fluid to said passageway.

3. The injector assembly as claimed in claim 2, wherein said passageway comprises a primarily laterally extending portion and a primarily axially extending portion, and wherein surfaces of said injector and said cavity are arranged to direct the mutually opposite reaction forces to a region of said injector where said passageway portions intersect.

4. The injector assembly as claimed in claim 2, wherein said connector applies lateral force in a direction along said primarily laterally extending portion of said passageway midway between two regions of inter-engagement between said injector and said inner surface of said cavity, thereby bisecting said injector.

5. The injector assembly as claimed in claim 1, wherein a space is provided between said inner surface of said wall and a region of said peripheral surface portion of said injector lying opposite a point of application of said applied force.

6. The injector assembly as claimed in claim 1, wherein said injector includes an axially extending portion defining said peripheral surface portion, said axially extending portion being part circular in lateral cross-section.

7. An injector assembly comprising an injector and a wall having an inner surface defining a cavity receiving said injector, said injector having a peripheral surface portion and said cavity having a portion corresponding to said peripheral surface portion, said peripheral surface portion and said corresponding portion of said cavity inner surface being configured to inter-engage such that force applied to said injector in a predetermined direction causes mutually oppositely directed reaction forces perpendicular to said applied force which tend to laterally compress said injector, for relieving lateral stress within said injector, wherein said injector includes an axially extending portion defining said peripheral surface portion, said axially extending portion being substantially circular in lateral cross-section, said inner surface of said wall being provided with two irregularities extending radially inwardly from said cavity inner surface, which is otherwise correspondingly circular in cross-section, thereby providing two regions of inter-engagement between said injector and said cavity inner surface for respectively providing the reaction forces.

8. The injector assembly as claimed in claim 7, wherein a space is provided between said inner surface of said wall and a region of said peripheral surface portion of said injector lying opposite a point of application of said applied force.

9. The injector assembly as claimed in claim 7, wherein said injector includes an axially extending portion defining said peripheral surface portion, said axially extending portion being part circular in lateral cross-section.

10. The injector assembly as claimed in claim 7, wherein said injector and said cavity are configured such that reaction forces having two mutually equal and opposite components are caused perpendicular to said applied force.

11. The injector assembly as claimed in claim 7, said injector having an axial end, wherein said injector includes a passageway for carrying high pressure fluid leading from the lateral periphery of said injector to said axial end, said applied force being applied laterally by a connector supplying fluid to said passageway.

12. The injector assembly as claimed in claim 11, wherein said passageway comprises a primarily laterally extending portion and a primarily axially extending portion, and wherein surfaces of said injector and said cavity are arranged to direct the mutually opposite reaction forces through a region of said injector where said passageway portions intersect.

13. The injector assembly as claimed in claim 11, wherein said connector applies lateral force in a direction along said primarily laterally extending portion of said passageway midway between two regions of inter-engagement between said injector and said inner surface of said cavity, thereby bisecting said injector.

14. The injector assembly as claimed in claim 7, wherein said wall comprises a body portion having a bore receiving a sleeve, said sleeve having an inner surface which defines said cavity.

15. An injector for fitting in a cavity of an injector assembly, said injector including an axially extending portion comprising at least two peripheral irregularities in an otherwise substantially regular lateral cross-section, wherein said axially extending portion is part circular in lateral cross-section, said axially extending portion including a relieved segment having an eccentrically disposed peripheral curve with a larger radius of curvature than said part circular cross-section, thereby providing two peripheral irregularities for engaging an inner surface of said cavity, said inner surface having a substantially circular cross-section.

* * * * *